United States Patent [19]

Zimmer

[11] 3,987,724

[45] *Oct. 26, 1976

[54] STENCIL INKER WITH RESILIENT APPLICATOR PORTION

[76] Inventor: Peter Zimmer, Untere Sparchen 54, A 6330 Kufstein, Austria

[ * ] Notice: The portion of the term of this patent subsequent to Apr. 13, 1993, has been disclaimed.

[22] Filed: Jan. 28, 1974

[21] Appl. No.: 437,039

[30] Foreign Application Priority Data

Feb. 1, 1973 Austria ..... 886/73

[52] U.S. Cl. ..... 101/119; 101/120; 101/366; 118/406

[51] Int. Cl.[2] ..... B41F 15/40; B41F 15/44

[58] Field of Search ..... 101/114, 115, 116, 119, 101/120, 123, 124, 366; 118/406, 213, 410, 411, 412

[56] References Cited

UNITED STATES PATENTS

| | | | |
|---|---|---|---|
| 2,203,910 | 6/1940 | Issartel et al. | 118/412 |
| 2,928,340 | 3/1960 | Stein et al. | 101/120 |
| 3,735,730 | 5/1973 | Mitter | 101/120 X |

FOREIGN PATENTS OR APPLICATIONS

| | | | |
|---|---|---|---|
| 836,793 | 4/1952 | Germany | 101/119 |

*Primary Examiner*—E. H. Eickholt
*Assistant Examiner*—R. E. Suter
*Attorney, Agent, or Firm*—Ernest G. Montague; Karl F. Ross; Herbert Dubno

[57] ABSTRACT

A dyestuff applicator, overlying an area of contact between a movable printing screen and a substrate, comprises a horizontal supply tube which supports an axially extending dyestuff-distributing member with freedom of relative mobility in a vertical axial plane of the tube. The bottom portion of the distributing member, forming an axially extending dyestuff outlet in the shape of a slot or a multiplicity of closely spaced apertures, is separated from its top portion, secured to the tube, by a bar-shaped body of relatively soft material which is readily compressible in the vertical direction while resisting deformation in a horizontal plane. The distributing member is weighted down by the pressure of the liquid dyestuff in a overlying space or by springs inserted between that member and the supply tube.

8 Claims, 5 Drawing Figures

STENCIL INKER WITH RESILIENT APPLICATOR PORTION

FIELD OF THE INVENTION

My present invention relates to a dyestuff applicator for a printing machine, more particularly a screen printer in which an apertured printing screen overlies a substrate to be imprinted and is movable together with that substrate in a predetermined direction.

BACKGROUND OF THE INVENTION

In my copending application Ser. No. 426,909, filed Dec. 13, 1973, I have disclosed a printing machine of this type wherein a supply tube is horizontally disposed inside a cylindrical printing screen and supports a dyestuff applicator divided into two relatively vertically movable parts, i.e. a guide structure secured to the underside of the supply tube and an elongate distributing member carried on that structure. The distributing member forms an outlet for the dyestuff along a narrow zone which is centered on a vertical axial plane of the supply tube and which can thus move up and down, in response to irregularities in the underlying substrate, substantially independently of the tube. The movement of the distributing member can be restrained, however, by interposed springs supplementing the weight of the overlying body of liquid, as likewise disclosed in the copending application.

OBJECT OF THE INVENTION

Particularly with wide screens and correspondingly long applicators, designed for printing on large webs, it is difficult to maintain uniformity of contact pressure over the entire outlet zone in the face of variations in the thickness of the substrate. Thus, the object of my present invention is to provide an improved applicator structure in which the effect of such thickness variations upon the position of the applicator is minimized.

SUMMARY OF THE INVENTION

I realize this object, in accordance with my present invention, by making the bottom portion of the applicator compressible in a vertical direction, perpendicularly to the screen surface, but substantially less deformable in a horizontal plane than in that vertical direction so that the proper position of the dyestuff outlet is maintained while irregularities in the screen surface, due to an unevenness of the underlying substrate, can readily be absorbed by the deformable applicator portion.

Advantageously, the deformable applicator portion is divided by an axially extending distributing channel, overlying the outlet zone, into two independently compressible halves whose deformability may be enhanced by the presence of horizontally extending bores therein, parallel or perpendicular to the channel but separated therefrom, or by axially extending clearances occupying a major part of the width of each half and flanking the channel. The channeled and vertically compressible bottom portion of the applicator may be bodily movable in a vertical direction, relatively to the supporting tube, as in the copending application referred to.

BRIEF DESCRIPTION OF THE DRAWING

The above and other features of my invention will now be described in detail with reference to the accompanying drawing in which.

SPECIFIC DESCRIPTION

Figure 1:
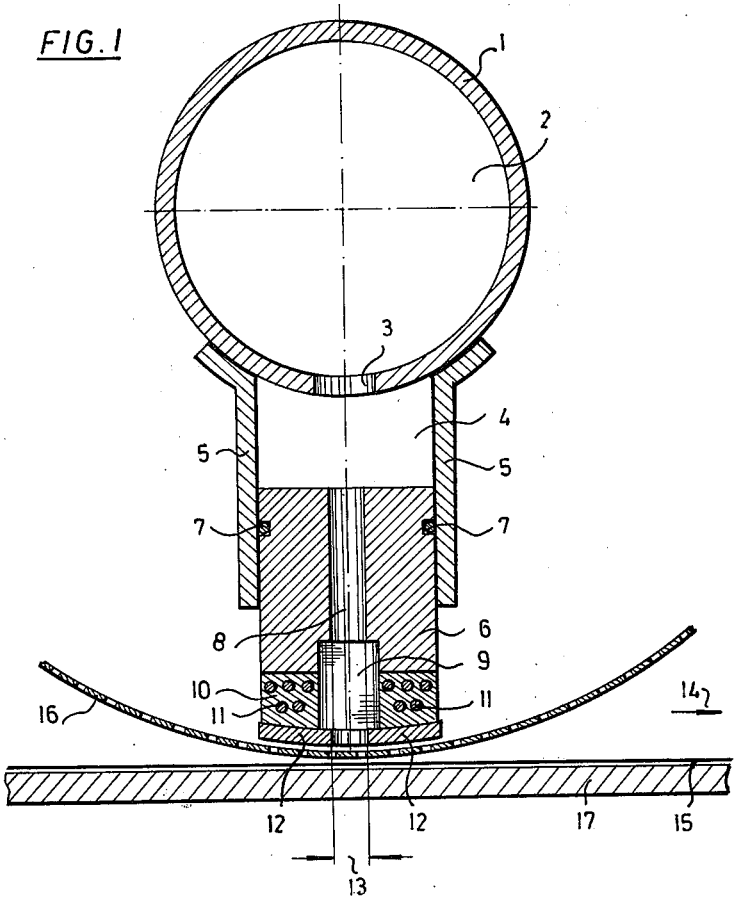
FIG. 1 is a cross-sectional elevational view of a dyestuff applicator embodying my invention.

FIG. 1 shows a supply tube 1 from whose interior 2 dyestuff passes through bores 3 into a space 4 bounded by two parallel walls 5 forming part of a dyestuff applicator according to my invention. Between these walls 5 a distributing member 6 is slidably mounted, this member consisting for example of synthetic resin or rubber of lower or higher Shore hardness; low hardness leads to a closer fit whereas high hardness affords better slidability. Member 6 has in its upper part a peripheral groove accommodating a sealing strip 7, e.g. of Teflon. A multiplicity of axially spaced vertical bores 8 in the slidable, elongate body 6 serve to conduct the dyestuff from space 4 to a horizontal channel 9 overlying a discharge slit 13 which constitutes the outlet of the applicator.

Figure 1A:
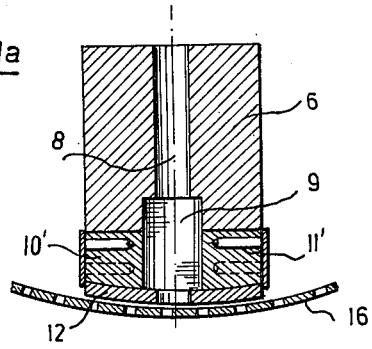
FIG. 1*a* is a view of the lower part of a modified applicator of the general type shown in FIG. 1.

A bottom portion 10 of member 6 is divided into two vertically compressible bar-shaped halves on opposite sides of channel 9. Each half is shown provided with a multiplicity of horizontal bores, isolated from channel 9 and occupied by inserts 11 of foam rubber, extending in the axial direction of the tube 1 to enhance the deformability of bars 10 in the vertical direction. These bars carry sliding strips 12 made of low-friction synthetic material, e.g. Teflon, which bound the slit 13 and help maintain its width as constant as possible. The bores in a pair of bars 10' may also extend perpendicularly to the tube axis, and parallel to the direction of movement 14 of a substrate 15 to be imprinted, as illustrated at 11' in FIG. 1*a*. The dyestuff passes from channel 9 through the discharge slit or gap 13 and an apertured screen 16 to the substrate 15 carried on a support 17.

Figure 2:
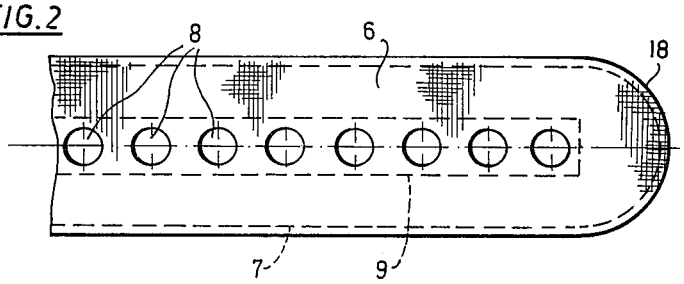
FIG. 2 is a fragmentary top view of a distributing member forming part of the applicator of FIG. 1.

In FIG. 2 the slidable member 6 is shown as having a semicircular end 18 to improve the sealing effect of the surrounding Teflon strip 7 by avoiding sharp bends.

Figure 3:
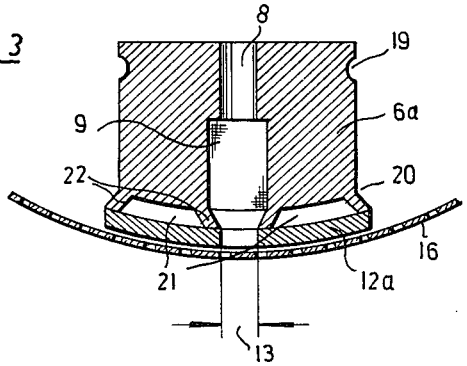
FIG. 3 is a view similar to FIG. 1*a*, illustrating a modified distributing member.

FIG. 3 shows a modified distributing member 6' with a peripheral groove 19 of semicircular cross-section into which a Teflon strip 7 (FIGS. 1 and 2) is again inserted. The bottom portion 20 of member 6' is provided on its underside with a pair of grooves 21 which are sealed by Teflon strips 12*a* to form two elongate clearances flanking the channel 9 and increasing the vertical compressibility of this portion. The grooves are laterally bounded by tabs 22 enabling the screen-contacting strips 12*a* to yield upwardly in the presence of thickness variations of the underlying substrate, along with the screen 16 which is of very small thickness. The clearances 21, whose height is substantially less than their width transverse to the axis of tube 1, can be filled with pressure fluid such as air, oil, water and the like. Such clearances could also be defined, for example, by flexible tubing bonded to portion 20 and supporting the Teflon strips 12*a*.

Figure 4:
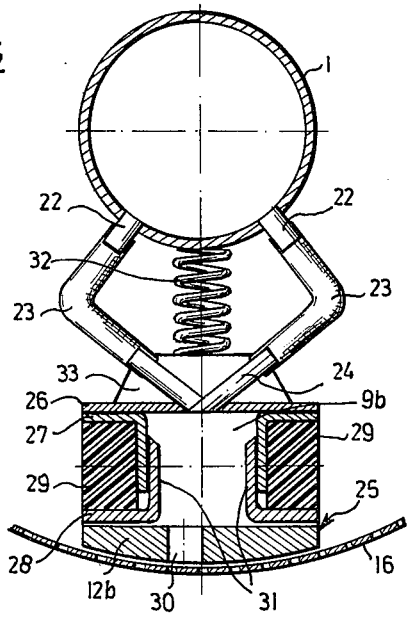
FIG. 4 is a view similar to FIG. 1, showing another embodiment.

FIG. 4 shows the supply tube 1 provided with nipples 22 connected to thin rubber hoses 23 which terminate at nipples 24 attached to a dyestuff applicator 25.

The applicator 25 comprises a metallic cover strip 26 and two pairs of rubber angle profiles 27, 28 each bracketing a foam rubber bar 29 on opposite sides of a channel 9*b* closed at the bottom by a Teflon strip 12*b*. The outlet of the applicator is here formed by a multiplicity of closely adjacent bores 30 which are relatively staggered in such a way that in all successive cross-sections transverse to the tube axis there exist approximately equal areas for the penetration of dyestuff through the screen 16. The angle profiles 27 and 28 are not bonded to each other but are relatively slidable along vertical contact surfaces 31. The foam-rubber bars 29 are extremely soft and deformable whereby, thanks to the low bending strength of the metallic cover strip 26, the whole lower applicator portion 27 – 29 can be readily compressed between the two strips 26 and 12*b* which have a somewhat higher modulus of elasticity. In the vicinity of the screen surface, therefore, the applicator is relatively stiff and nondeformable in the horizontal direction but flexible and yieldable in a direction perpendicular to the screen surface as neither the profiles 27, 28 nor the bars 29 can transmit substantial vertical thrusts or shear stresses between elements 26 and 12*b*. The lower, movable applicator portion 25 can therefore adjust itself easily to unevenness of the substrate acting on the screen 16. This leads to a very close contact between the sliding strip 12*b* and the screen surface, and therefore also to a good seal. The width of the strip 12*b* can be small if suppression of leakage is important, yet greater widths tend to reduce wear. The distributor member 25 is pressed by springs 32, which bear upon the tube 1, against the screen 16. The spring force is transmitted to member 25 via riders 33 which are fastened to the cover strip 26.

I claim:

1. In a printing machine, in combination:

an apertured screen overlying a substrate to be imprinted along a contact area, said screen and said substrate being movable in a predetermined direction;

a horizontal supply tube with an axis in a plane perpendicular to said predetermined direction connected to a source of dyestuff and spacedly disposed above said contact area; and a dyestuff applicator mounted on said tube and resting upon said screen, said applicator being provided with a bottom portion engaging said screen and forming an outlet along a narrow zone of said contact area centered on a vertical axial plane of said tube, said bottom portion being compressible in a vertical direction while being substantially less deformable in a horizontal plane than in said vertical direction, said outlet communicating with the interior of said tube.

2. The combination defined in claim 1 wherein said bottom portion is mounted with vertical bodily mobility relative to said tube.

3. The combination defined in claim 1 wherein said bottom portion is provided with an axially extending channel overlying said outlet, said channel dividing said bottom portion into two independently compressible halves.

4. The combination defined in claim 3 wherein each of said halves is provided with a multiplicity of horizontally extending bores separated from said channel.

5. The combination defined in claim 3 wherein each of said halves has an axially extending clearance flanking said channel, said clearance having a height substantially less than its width transverse to said axis.

6. The combination defined in claim 5 wherein said clearance is closed against said screen by a low-friction strip.

7. The combination defined in claim 3 wherein each of said halves is a foam-polymer bar and is provided with upper and lower reinforcing profiles overlapping each other along a vertical surface of said bar.

8. The combination defined in claim 7 wherein said reinforcing profiles are disposed along confronting sides of said bars bounding said channel.

* * * * *